US005566750A

United States Patent [19]

Arpalahti et al.

[11] Patent Number: 5,566,750

[45] Date of Patent: Oct. 22, 1996

[54] METHOD AND APPARATUS FOR COOLING HOT GASES

[75] Inventors: Olli E. Arpalahti, Varkaus; Ossi Ikonen, Pieksämäki; Arto Jäntti, Joroinen, all of Finland

[73] Assignee: Foster Wheeler Energia Oy, Helsinki, Finland

[21] Appl. No.: 436,207

[22] Filed: Jun. 20, 1995

[30] Foreign Application Priority Data

Nov. 16, 1992 [FI] Finland ..... 925185

[51] Int. Cl.[6] ..... F28D 13/00

[52] U.S. Cl. ..... 165/104.16; 165/104.18; 432/72

[58] Field of Search ..... 110/216, 245; 122/40; 432/72, 106; 165/104.16, 104.18

[56] References Cited

U.S. PATENT DOCUMENTS 4,119,395 10/1978 Hatanaka et al. ..... 431/11
4,896,717 1/1990 Campbell, Jr. et al. ..... 165/104.18
5,226,475 7/1993 Ruottu ..... 165/104.18

FOREIGN PATENT DOCUMENTS 1372431 8/1964 France .
1501382 12/1969 Germany .
WO92/01202 1/1992 WIPO .

*Primary Examiner*—Noah P. Kamen
*Attorney, Agent, or Firm*—Nixon & Vanderhye P.C.

[57] ABSTRACT

The invention relates to a method and apparatus for cooling the exhaust gases of a molten stage furnace. The method relates to furnace structures in which the shaft (3) is vertical and the exhaust gases are passed through an outlet in the furnace roof to the cooling equipment without recovering heat from the exhaust gases through the wall portions above the furnace. The exhaust gases are cooled in two stages first indirectly by a circulating mass cooler (1) and then further in a waste heat recovery boiler. In the apparatus according to the invention, the vertical shaft section above the furnace is connected to a circulating mass cooler which is connected to a waste heat recovery boiler arranged, e.g., next to the furnace and/or the shaft.

20 Claims, 1 Drawing Sheet

METHOD AND APPARATUS FOR COOLING HOT GASES

TECHNICAL FIELD

The present invention relates to a method of and an apparatus for cooling the exhaust gases from a molten phase furnace, such as a smelting furnace. The method relates to furnace structures which have a vertical shaft and in which the exhaust gases of the furnace are discharged through an outlet in the roof of the furnace.

The present invention is particularly well applicable to the recovery of heat from the exhaust gases of metal smelteries, such as smelting prosesses of metal sulfides but it can be applied also to other processes in which hot fouled gases must or are desired to be cooled and in which water-cooled surfaces may impose a risk.

BACKGROUND ART

Typically, the exhaust gases of metal smelteries are hot gases of 1100°–1400° C., and they contain solid material, i.e. dust which is partly in a molten state, and gas components which during cooling, e.g. down to 200°–400° C., condense to a solid phase.

Usually, the treatment of exhaust gases from this kind of processes has been arranged by cooling the gas first in a waste heat recovery boiler generating saturated or sometimes superheated steam and by separating, subsequent to the waste heat boiler, solids from the gas for example in an electric filter. In smelteries, the use of a steam boiler is based on the possibility of generating electricity by means of a steam turbine to satisfy the demand of the plant and also to be sold.

Most metal sulfide smelting processes employ a smelting furnace structure in which the discharge of the exhaust gases is easiest and simplest effected upwards through an opening provided in the roof of the furnace. U.S. Pat. No. 4,087,274 discloses a smelting furnace from which the exhaust gases are removed via an opening in the roof of the furnace.

This arrangement, however, involves a risk if the steam boiler or its first heat surfaces are constructed directly above the smelting furnace extending upwards from the opening provided in the roof of the furnace. Bursting of a steam boiler tube causes a water leakage which results in a risk of explosion in the smelting furnace if the water spraying out from the leakage point runs down to the smelt.

To solve the above problem, the boiler located on top of the furnace could be provided with a superheater. The medium flowing in these heat surfaces is steam and the section located above the furnace serves as a superheater for steam. The more risky heat surfaces, i.e. the evaporators containing boiler water, would be installed further off and not directly above the smelt. In practice, a construction of this kind is, however, impossible, for example because one of the biggest problems in cooling of the gases is the sticking of dust to the heat surfaces which results in a tendency of the surfaces to clogg which in turn increases the heat transfer resistance. An increase in the temperature of the surface intensifies this phenomenon and therefore the heat surfaces of this kind of boilers are usually designed to give an as high cooling effect as possible and to serve as evaporating surfaces generating saturated steam instead of hot superheater surfaces. If necessary in some applications, the steam produced in this kind of boilers is superheated in a separate superheating boiler prior to the steam turbine. Another drawback of this application is the fact that at the steam pressures concerned (i.e. less than 100 bar) the thermal energy for superheating compared with the thermal energy for evaporation is so low that superheating alone would not suffice for achieving adequate cooling in the boiler portion disposed above the furnace. The use of a steam pressure exceeding 100 bar would, on the other hand, result in the temperature of the evaporation surfaces rising too high for example in view of cleaning.

A conventional boiler arrangement used in smelteries is a horizontal boiler arranged at a side of the smelting furnace, thereby avoiding the risk of an explosion caused by a water leak. A similar boiler arrangement is used, e.g. in a smelting process disclosed in U.S. Pat. No. 4,073,645. The arrangement has proved to operate well but the boiler structure is expensive and space consuming and thus, on the whole, the use of this kind of technique impairs the economy of the heat recovery from the exhaust gas.

DISCLOSURE OF INVENTION

An object of the invention is to provide an improved method and apparatus compared with those described above for recovering heat from the exhaust gases from smelting or combustion furnaces, and especially to provide an arrangement which is safe in operation.

A further object of the invention is to provide an economical method for heat recovery from the exhaust gases, in which method the heat of the hot gases may be optimally utilized and the temperature of the exhaust gases be lowered to a level required for gas cleaning. Thus this arrangement is more efficient than the conventional horizontal units in which the transfer of heat in the cooling process e.g. from a temperature of 700°–2000° C. to a temperature of 400°–700° C. is based mainly on radiation.

The method of the invention for achieving the objects of the invention is characterized in that the gases are directed to the cooling apparatus without recovering heat through the wall portions above the furnace. The exhaust gases are cooled in two stages, the first of which is an indirect cooling in a circulating mass cooler. Subsequently, the cooled gases are further cooled in a waste heat recovery boiler in which the heat of the gases is recovered by evaporating water in evaporating heat exchangers of the boiler.

The heat transferred from the exhaust gas to the circulating mass during the cooling of the gas in the mixing chamber of the circulating mass cooler may be utilized by transferring the heat from the circulating mass to an appropriate medium by means of heat exchangers in a fluidized bed cooler provided in a separate space. These heat exchangers may be connected to the same water/steam circulation as the convection section of the waste heat boiler.

The cooling of the gases in the circulating mass cooler is preferably effected by cooler in which the mixing chamber disposed above the shaft of the furnace and the rising conduit, the so-called riser, do not have pressurized heat transfer surfaces connected to the same water/steam circulation as the boiler surfaces of the convection section of the waste heat boiler, but the structure is substantially non-cooled; if necessary the internal surface may be lined with a refractory material. The circulating mass separated in a cyclone separator, which is disposed in the rising conduit subsequent to the mixing chamber and may be non-cooled or at least partly cooled, falls down to a fluidized bed cooler in which the circulating mass separated from the exhaust gas from the furnace is fluidized by means of separate fluidizing gas. In this fluidized bed cooler, boiler surfaces are provided to serve as cooling elements whereby the heat contained by the circulating mass may be transferred to the medium flowing in these cooling elements without any risk. By the method according to the invention, the heat surfaces above the shaft which cause the safety risk may be located in the fluidized bed cooler in which the heat can be recovered without any risk. The design of the fluidized bed cooler allows the majority of the cooling to be effected by means of the boiler surfaces while only a minor portion of the heat is bound by the fluidizing gas. The cooled circulating mass returns preferably as overflow of the fluidized bed via a connection conduit back to the mixing chamber into which also most of the fluidizing gas of the cooler may be passed.

For achieving the objects of the invention the apparatus of the invention is characterized in that the vertical shaft arranged above the furnace and communicating via its bottom portion with the furnace is connected to a circulating mass cooler for cooling the exhaust gases from the furnace so that no heat transfer surfaces containing pressurized heat transfer medium are disposed above the exhaust gas discharge opening of the furnace. The circulating mass cooler may be further connected to a waste heat recovery boiler provided beside the furnace and/or the shaft. The solids circulating system disposed between the shaft and the waste heat boiler comprises

- a mixing chamber for the circulating mass placed above the shaft of the furnace for bringing the exhaust gas and the circulating mass to contact each other efficiently;
- a rising conduit;
- a separator for separating the heated circulating mass from the exhaust gas;
- a fluidized bed cooler for cooling the circulating mass heated in the mixing chamber and subsequent means; and
- means for transporting the circulating mass between the mixing chamber, the separator and the fluidized bed cooler.

The circulating mass cooler according to the invention may be disposed above the vertical shaft provided on top of the furnace. The waste heat recovery boiler is preferably arranged beside the shaft or the furnace. There are no pressurized heat transfer surfaces containing heat transfer medium in the mixing chamber, typically having a temperature of 400°–700° C., or in the shaft; thus, the mixing chamber may economically and without risk be disposed the way descibed above. The convection section containing boiler surfaces is located so that, in case of a burst of the heat transfer surfaces of the means containing heat transfer medium and the subsequent leak of the heat transfer medium, the heat transfer medium cannot contact the molten material which eliminates the risk of an explosion.

The circulating mass cooling according to the invention cools the furnace exhaust gas having prior to the mixing chamber a temperature of 700°–2000° C. to a sufficiently low temperature; for example to 350°–900° C., preferably to 400°–700° C., to condensate the smelt solids contained by the gas to a solid phase. This is carried out by mixing in the mixing chamber the hot gas with the cooled circulating mass typically having a temperature of 250°–400° C. Thus the dust contained in the gas does not stick to the surrounding surfaces and cause a danger of clogging; i.e. the gas cools down during the mixing stage past the temperature range in which the dust contained in the gas to be cooled is at least partly in a molten state.

The furnace exhaust gas cooling system according to the invention based on the circulation of solids may operate e.g. in the velocity range of a circulating fluidized bed reactor, the velocity being 2–20 m/s depending on the density and the size of the particles. This velocity range is advantageous for example when it is necessary to prolong the retention time of the circulating mass or increase the particle size by agglomeration in the reactor. In addition to the velocity range of the circulating fluidized bed reactor, another alternative aspect of the invention is to increase the velocity to 10–30 m/s whereby pneumatic transport is concerned. In this way, the flow becomes smoother and pulsation of pressure is eliminated which is very important for the operation of the smelting furnace. Many smelting furnaces operate with sub-atmospheric pressure and the control of their operation allows only very small pressure fluctuations in the furnace, e.g. deviations of 100 Pa from the set value in either direction, or even less. When operating at the pneumatic transport velocity ranges, also the pressure loss of the gas over the circulating mass cooler and the cyclone outlet reduces substantially which results in remarkable savings in the electricity consumption.

The primary advantage provided by the invention is that on top of the shaft of the smelting furnace, there are no boiler surfaces causing a safety risk whereby the safety of the apparatus is remarkably improved. Further, the availability of the apparatus is improved as in case of a leakage in the boiler surfaces measures are needed only in apparatus connected with the boiler and no other equipment which results in further cost savings.

A further advantage provided by the arrangement of the invention of indirectly cooling the exhaust gas with circulating mass is that heat transfer coefficient in the fluidized bed cooler is approx. 5–10 times higher than in the surfaces of a radiation section of a conventional waste heat recovery boiler which reduces the heat transfer surface area required even if the temperature difference between the gas delivering the heat and the surface receiving the heat is smaller.

BRIEF DESCRIPTION OF DRAWINGS

The invention is described more in detail and by way of example below with reference to the accompanying drawing figures of which.

MODES FOR CARRYING OUT THE INVENTION

Figure 1:
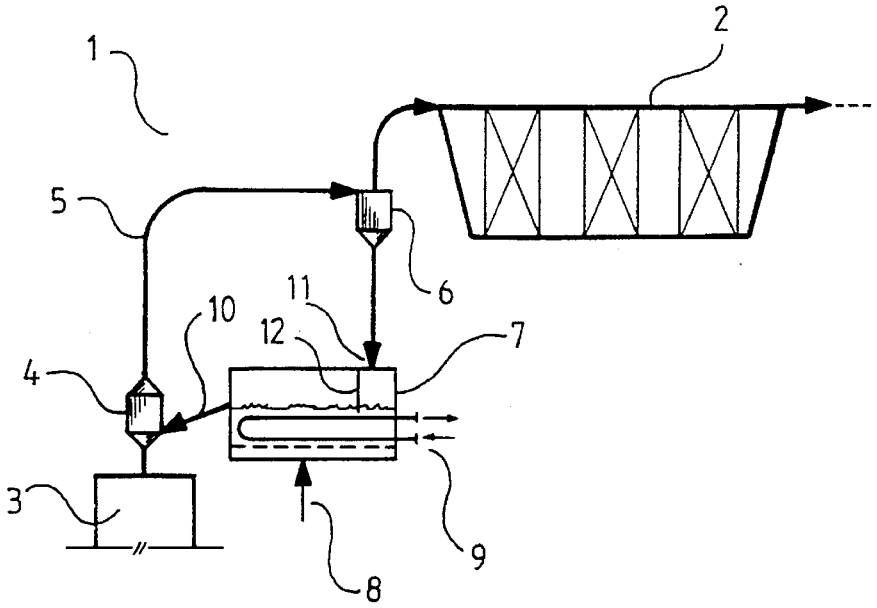
FIG. 1 illustrates schematically an embodiment of the invention for cooling exhaust gas.

FIG. 1 illustrates an apparatus for cooling exhaust gases from a smelting furnace. The exhaust gas is cooled in a circulating mass cooler (1) after which the cooled gas is passed for example to a convection section (2) of the furnace. The circulating mass cooler (1) is provided above a shaft (3) of the smelting furnace. The exhaust gases flow via the shaft of the furnace through the circulating mass cooler further to a waste heat revocery boiler, to a second cooling stage.

In the flow direction of the exhaust gas, the first section of the circulating mass cooler (1) according to FIG. 1 is a mixing chamber (4) in which the gases having a temperature of 700°–2000° C. and flowing upwards from the shaft (3) of the furnace are brought to contact and mixed with circulating mass introduced from a fluidized bed cooler. From the mixing chamber in which the mixing temperature of the gas and the circulating material typically decreases to 400°–700° C. the mixture of gas and solid material flows via a rising conduit (5) to a cyclone separator (6). In this stage, the hot gas exiting the furnace is treated so that part of its heat is transferred to the circulating mass and its components fouling the heat surfaces have cooled down so much that they do not cause problems. The circulating solid material is separated from the gas in the cyclone (6) and the gases are passed further from the cyclone to the subsequent cooling stage to the convention section (2) of the waste heat recovery boiler. The circulating solid material separated in the cyclone separator (6) from the gas is transported to a fluidized bed cooler (7) into which fluidizing gas is introduced by means (8). Heat transfer means (9) are provided in the fluidized bed to serve as cooling elements and they may be connected to the same water/steam system as the boiler surfaces of the convection section of the waste heat boiler. From the fluidized bed cooler the circulating solid material, which typically has cooled down to 250°–400° C., flows in a connection conduit (10) down to the mixing chamber. The return of the circulating mass to the mixing chamber may be effected also by other known methods. The fluidizing air passes mainly to the mixing chamber since, preferably, there is a gas seal (11), e.g. an L-bend, provided between the separation cyclone and the fluidized bed cooler or the fluidized bed cooler itself is preferably provided with means, e.g. a partition wall (12), to ensure that the fluidizing air is essentially entrained to the mixing chamber, and also to ensure that no blow-through takes place from the mixing chamber via the fluidized bed cooler to the cyclone.

Figure 2:
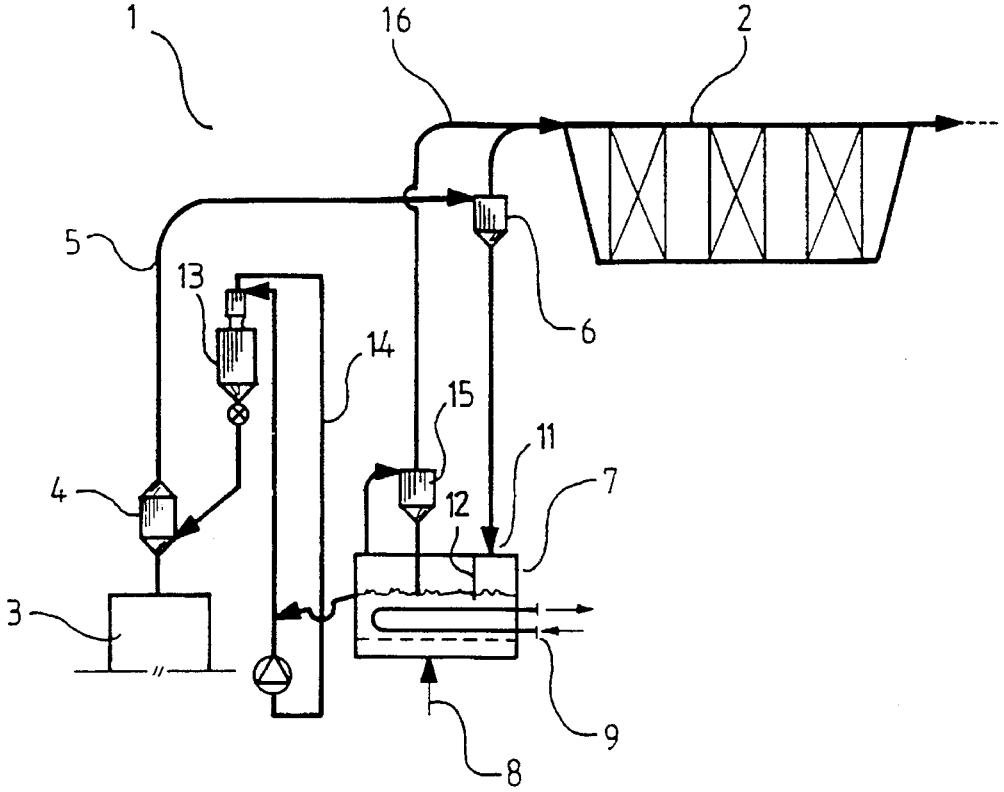
FIG. 2 illustrates schematically another embodiment of the invention for cooling exhaust gas.

FIG. 2 illustrates an embodiment of the invention for applications in which the fluidized bed cooler is disposed below the smelting furnace.

In the embodiment of FIG. 2, the first section of a circulating mass cooler (1) in the flow direction of the exhaust gas is a mixing chamber (4) in which the gases typically having a temperature of 700°–2000° C. and flowing upwards from a shaft (3) of the furnace are brought to contact and mixed with the circulating mass introduced from a solids container (13). From the mixing chamber in which the mixing temperature of the gas and the circulating mass typically reduces to 400°–700° C., the mixture of gas and circulating material flows upwards in a rising conduit (5) to a cyclone separator (6). In this stage, the hot gas exiting the furnace is treated so that part of its heat is transferred to the circulating mass and its components fouling the heat surfaces have cooled so much that they do not cause problems. In the cyclone separator (6), the solid material is separated from the gas and the gas is passed to the subsequent cooling stage, i.e. the convection section (2) of a waste heat boiler. The solid material separated in the cyclone separator (6) from the gas drops down to a fluidized bed cooler (7) into which fluidizing gas is introduced by means (8). Heat transfer means (9) are provided in the fluidized bed to serve as cooling elements and they may be connected to the same water/steam system as the boiler surfaces of the convection section of the waste heat boiler. From the fluidized bed cooler the circulating mass, which typically has cooled down to 250°–400° C., flows e.g. as overflow of the fluidized bed in a connection pipe (10) to a transport system (14) which transports the solid material back to the solids container (13). In the embodiment, the fluidizing air is introduced to the waste heat recovery boiler via a separator (15) and a conduit (16).

Industrial applicability

While the invention has been herein shown and described in what is presently conceived to be the most practical and preferred embodiments, it will be apparent to those of ordinary skill in the art that many modifications may be made thereof within the scope of the invention, which scope is to be accorded the broadest interpretation of the appended claims so as to encompass all equivalent structures and procedures.

We claim:

1. A method of cooling exhaust gases at a first temperature from a molten phase furnace passing upwardly through a vertical shaft, using a fluidized bed of particles, comprising the steps of:

(a) mixing the upwardly flowing exhaust gases with particles having a second temperature lower than the first temperature;

(b) passing the exhaust gases mixed with particles upwardly without recovering heat therefrom;

(c) during the practice of step (b), removing particles from the exhaust gases and passing them in a first path to the fluidized bed of particles, while passing the gases with removed particles in a second path;

(d) recovering heat from the particles in the fluidized while simultaneously cooling the particles, and then using the cooled particles in step (a); and (e) recovering heat from the gases moving in the second path.

2. A method as recited in claim 1 wherein step (e) is practiced in a convection furnace section to produce saturated or superheated steam.

3. A method as recited in claim 2 wherein the gases in the vertical shaft at the first temperature are between about 700–2000 degrees C., and wherein step (a) is practiced by mixing with the gases particles at a temperature of between about 250–400 degrees C.

4. A method as recited in claim 3 wherein steps (a)–(d) are practiced to cool the exhaust gases to a temperature of between about 400–700 degrees C.

5. A method as recited in claim 1 wherein step (c) is practiced by cyclonic separation.

6. A method as recited in claim 5 wherein step (a) is practiced by overflowing particles from the fluidized bed of particles directly into contact with the upwardly flowing exhaust gases.

7. A method as recited in claim 1 wherein step (a) is practiced by overflowing particles from the fluidized bed of particles directly into contact with the upwardly flowing exhaust gases.

8. A method as recited in claim 1 wherein step (a) is practiced by passing cooled particles from the fluidized bed to a separate, pneumatic, transport system, and passing the cooled particles into contact with the upwardly flowing exhaust gases using the pneumatic transport system.

9. A method as recited in claim 1 wherein step (d) is practiced by passing cooling liquid through a heat exchanger in the fluidized bed.

10. A method as recited in claim 1 wherein the gases in the vertical shaft at the first temperature are between about 700–2000 degrees C., and wherein step (a) is practiced by mixing with the gases particles at a temperature of between about 250–400 degrees C.

11. A method as recited in claim 10 wherein steps (a)–(d) are practiced to cool the exhaust gases to a temperature of between about 400–700 degrees C.

12. Apparatus for cooling exhaust gases from a vertical shaft, of a molten phase furnace, comprising:

a mixing chamber connected to the vertical shaft, above the furnace;

means for introducing cooled particles into said mixing chamber to be mixed with exhaust gases therein;

a non-liquid-cooled conduit extending upwardly from said mixing chamber;

a fluidized bed of particles with heat recovery means for recovering heat from particles in said fluidized bed while simultaneously cooling the particles;

said fluidized bed connected to said means for introducing cooled particles into said mixing chamber;

a separator connected to said non-cooled conduit for separating particles from gases introduced into said separator from said mixing chamber, and passing the particles in a first path to said fluidized bed, while passing gases in a second path; and a second stage heat recovery boiler connected to said second path.

13. Apparatus as recited in claim 12 wherein said separator comprises a cyclonic separator.

14. Apparatus as recited in claim 12 wherein said means for introducing cooled particles into said mixing chamber comprises an overflow conduit connected directly between said fluidized bed and said mixing chamber.

15. Apparatus as recited in claim 12 wherein said means for introducing cooled particles into said mixing chamber comprises a solids container connected by a first conduit to said fluidized bed and by a second conduit to said mixing chamber.

16. Apparatus as recited in claim 15 further comprising a pneumatic transport system disposed between said first conduit and said solids container for transporting cooled particles from said fluidized bed to said solids container.

17. Apparatus as recited in claim 16 wherein said fluidized bed is at a vertical level below said vertical shaft.

18. Apparatus as recited in claim 15 wherein said fluidized bed is at a vertical level below said vertical shaft.

19. Apparatus as recited in claim 12 wherein said fluidized bed is at a vertical level above said vertical shaft.

20. Apparatus as recited in claim 12 wherein said fluid bed heat recovery means comprises a heat exchanger within said fluidized bed and through which liquid is passed.

* * * * *

UNITED STATES PATENT AND TRADEMARK OFFICE

CERTIFICATE OF CORRECTION

PATENT NO. : 5,566,750
DATED : Oct. 22, 1996
INVENTOR(S) : Olli E. Arpalahti, et al It is certified that error appears in the above-identified patent and that said Letters Patent is hereby corrected as shown below:

Title page, after "[22]" insert --PCT--, change "Jun. 20, 1995" to --Nov. 15, 1993-- and add a first new section --[86] PCT No.: PCT/F193/00479
ξ371 Date: June 20, 1995
ξ102 (e) Date: June 20, 1995
[87] PCT Pub. No.: WO94/11691 PCT Pub. Date: May 26, 1994--

Signed and Sealed this

Seventh Day of October, 1997

*Attest:*

Bruce Lehman

BRUCE LEHMAN

*Attesting Officer*

*Commissioner of Patents and Trademarks*